US008267710B2

(12) United States Patent
Pfeiffer

(10) Patent No.: US 8,267,710 B2
(45) Date of Patent: Sep. 18, 2012

(54) CONNECTION APPARATUS

(75) Inventor: Klaus Pfeiffer, Heidenheim (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 12/987,964

(22) Filed: Jan. 10, 2011

(65) Prior Publication Data

US 2011/0165787 A1 Jul. 7, 2011

Related U.S. Application Data

(63) Continuation-in-part of application No. 11/816,973, filed as application No. PCT/EP2006/001560 on Feb. 21, 2006, now Pat. No. 7,866,992, application No. 12/987,964, which is a continuation-in-part of application No. 12/869,876, filed on Aug. 27, 2010, now Pat. No. 8,079,855.

(30) Foreign Application Priority Data

Feb. 23, 2005 (DE) ..... 20 2005 002 921

(51) Int. Cl.
*H01R 13/54* (2006.01)

(52) U.S. Cl. ..... 439/332; 439/140

(58) Field of Classification Search ..... 439/332, 439/140, 137
See application file for complete search history.

(56) References Cited

U.S. PATENT DOCUMENTS

| | | | | | |
|---|---|---|---|---|---|
| 1,634,407 | A | * | 7/1927 | Douglas | 439/336 |
| 2,102,625 | A | | 12/1937 | Hubbell, Jr. | |
| 2,264,687 | A | * | 12/1941 | Kovatch et al. | 439/335 |
| 3,233,203 | A | | 2/1966 | Kennedy et al. | |
| 3,339,171 | A | | 8/1967 | Carlson | |
| 3,725,840 | A | * | 4/1973 | Hesse | 439/335 |
| 4,072,385 | A | * | 2/1978 | Wallner | 439/335 |
| 4,359,256 | A | * | 11/1982 | Gallusser et al. | 439/335 |
| 4,550,967 | A | * | 11/1985 | Riches et al. | 439/332 |
| 4,645,281 | A | * | 2/1987 | Burger | 439/133 |
| 4,762,503 | A | * | 8/1988 | Bohle et al. | 439/336 |
| 5,205,749 | A | * | 4/1993 | Weingartner | 439/335 |
| 5,411,411 | A | * | 5/1995 | Ogawa et al. | 439/336 |
| 5,704,806 | A | * | 1/1998 | Post et al. | 439/546 |
| 5,749,743 | A | * | 5/1998 | Harada et al. | 439/336 |
| 5,823,806 | A | | 10/1998 | Nagase et al. | |
| 6,297,741 | B1 | * | 10/2001 | Higgins | 340/631 |
| 6,309,231 | B1 | | 10/2001 | Gordon et al. | |
| 6,364,681 | B1 | * | 4/2002 | Watanabe | 439/335 |
| 7,322,859 | B2 | | 1/2008 | Evans | |

FOREIGN PATENT DOCUMENTS

| | | | |
|---|---|---|---|
| DE | 4208479 | A1 | 9/1993 |
| FR | 2339948 | A | 8/1977 |
| GB | 866308 | A | 4/1961 |

* cited by examiner

*Primary Examiner* — Gary F. Paumen
(74) *Attorney, Agent, or Firm* — GrayRobinson, PA

(57) ABSTRACT

A connection apparatus includes a male plug which may be mated into bayonet-type engagement with a female socket. The plug has at least one radially projecting lug and the socket has at least one axially extending insertion channel and at least one adjoining locking channel within which the lug may be received. The locking channel includes at least one depression which is located radially angularly offset from the insertion channel. Engagement between the lug with the depression resists unintentional detachment of the connection.

12 Claims, 8 Drawing Sheets

CONNECTION APPARATUS

CROSS-REFERENCE TO RELATED APPLICATIONS

This application is a continuation-in-part of, and claims priority under 35 U.S.C. §120 to, co-pending U.S. patent application Ser. No. 11/816,973 filed Sep. 17, 2008 which is a U.S. National Phase Entry Under 35 U.S.C. §371 of International Patent Application No. PCT/EP2006/001560, filed Feb. 21, 2006 which designated the United States and at least one other country other than the United States and which claims priority to German Patent Application No. 20 2005 002 921.1, filed Feb. 23, 2005. This application also is a continuation-in-part of, and claims priority under 35 U.S.C. §120 to, co-pending U.S. patent application Ser. No. 12/869, 876 filed Aug. 27, 2010 which is a divisional of U.S. patent application Ser. No. 11/816,973.

INCORPORATION BY REFERENCE

U.S. patent application Ser. Nos. 11/816,973 and 12/869, 876 and International Patent Application No. PCT/EP2006/001560 and German Patent Application No. 20 2005 002 921.1 are each expressly incorporated herein by reference in their respective entireties to form a part of the present disclosure.

BACKGROUND OF THE INVENTION

The invention relates to a connection apparatus of the having a plug and having a socket which are engageable with one another to form bayonet-type connection.

Bayonet-type connections for a secure connection between a plug and a socket are generally known.

In vehicle construction, in particular in motor vehicle construction, mechanical, and above all, also electrical connection systems are increasingly required also in the luggage area, for example in the trunk, in the region of the rear seats and loading area. The known electrical connection systems are inconvenient owing to their design or represent disruptive elements. This applies in particular to the trunk, where if possible no protruding parts are desired. When the known electrical connection systems are not in use, in the prior art the socket is covered by a separate covering element if the connection does not remain completely open. The latter case is particularly prevalent if the covering element is lost.

SUMMARY OF THE INVENTION

The present invention is therefore based on the object of providing a connection, or may be configured to have, system of the type mentioned at the outset which has a relatively small physical depth and does not become disruptive either in the installed state or when not in use.

This object is achieved according to the invention by virtue of the fact that the bayonet-type connection in the socket has at least one axially running insertion channel and at least one adjoining locking position which is offset in the circumferential direction with respect thereto, the front side of the socket which is provided for connection to the plug being covered by a cover, which is arranged in the socket displaceably such that, when the plug is positioned, the opening is released by said plug for the purpose of producing the connection.

Owing to the fact that the bayonet is designed to have the axial insertion channel and the locking position, which is offset with respect thereto in a circumferential direction, for example a locking channel running in a circumferential direction, firstly a secure connection is provided and secondly, however, only a relatively low physical depth is required. Owing to the arrangement according to the invention of the cover, the socket, when not in use, can be integrated so as not to be disruptive in the area surrounding the socket or can be adapted so as to correspond to said socket. It is thus possible, for example, for it to be installed in a vehicle wall or a loading floor. At the same time, a cover for resisting contamination of the electrical contacts is provided, with the result that the functioning of the electrical contacts is also not impaired in the event of use for a relatively long period of time.

In this case, the socket can be installed into an opening in a wall of a component in such a way that the surface of the socket, together with the cover, is at least approximately flush with the surface of the wall part surrounding the socket. This means that damage to the socket is thus avoided and a loading area is not impaired by protruding parts.

In the case of an electrical connection system, the contacts may optionally be arranged circumferentially, for making faultless electrical contact, in addition to which, when the electrical connection is led through owing to the rotary movement of the plug in the socket, the contacts are always exposed, as a result of which oxidation is avoided.

The displaceability of the cover and the releasing of the opening of the socket for a connection can take place in a variety of ways. In a simple manner, a spring device may be provided for this purpose which pushes the cover back when the plug is inserted into the bayonet-type connection. Once the plug has been removed, owing to a spring prestress, the cover can, if desired, be positioned in front of the free front side again.

In addition to being useful to as an electrical connection apparatus, a connection system according to the invention can also at the same time be provided for a mechanical connection. It is merely necessary for this purpose for a correspondingly designed connecting element to be provided as the plug, which connecting element is provided, for example, with a hook or an eye in order to be able to attach, for example, a tensioning cable thereto. Likewise, such a fastening element can also be used as a suspension device.

The foregoing and other objects, features and advantages of the invention will become clear to those of ordinary skill in the art upon review of the written description of preferred embodiments as set forth below and the appended drawings in which like reference numerals are used to designate like items.

DETAILED DESCRIPTION OF PREFERRED EMBODIMENTS

Figure 1:
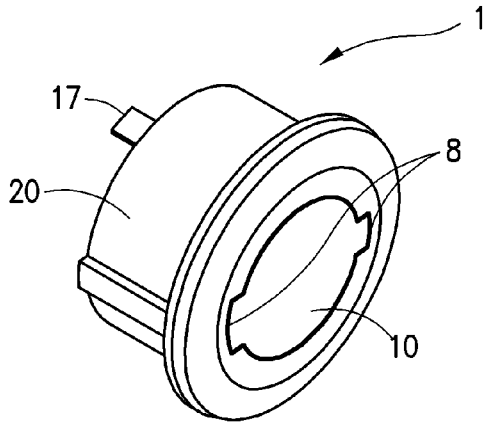
FIG. 1 shows a perspective illustration of the socket according to the invention.

Referring initially to FIGS. 1 through 4, a connection system has a socket 1 and a plug 2 which mate with one another. Plug 2 may be in the form of a mechanical plug 2*a*, which provides a solely mechanical connection with socket 1. Alternatively, plug 2 may take form of an electrical plug 2*b* which, when mated to socket 1, provides at least one electrical connection between socket 1 and electrical plug 2*b* in addition to making a mechanical connection between them. As can be seen from FIG. 3, the mechanical plug 2*a* optionally but preferably has a knurled knob 3 on the side thereof remote from its front part 56. In addition, the knurled knob 3 can optionally be provided with a fastening element 31, such as a hook or an eye of the type illustrated in FIG. 15 but not shown in FIG. 4 or 4. A feature which both types 2*a*, 2*b* of plug 2 have in common is that they are designed to make a bayonet-type connection with a mating socket 1. For this purpose, the plug 2 has a cylindrical portion 4 which projects outward from its front part in the direction of an insertion axis 44. Two lugs 5, which preferably but not necessarily are positioned radially angularly opposite one another, protrude radially outward from the circumference of the cylindrical portion 4. In the case of the electrical plug 2*b*, electrically conductive contact elements 6 are arranged on the outside or over the circumference of each of the two lugs 5. Contact elements 6 lead, via the interior of the plug 2*b*, to a connection branch 7 of the plug 2*b*, from where, correspondingly, one or more wires or cables 40, illustrated schematically by a single dashed line in FIG. 4, lead to an electrical load 42.

Figure 5:
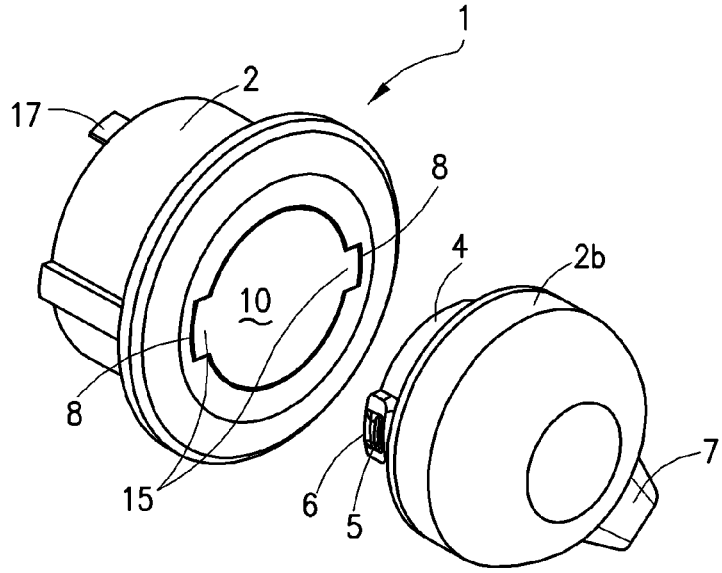
FIG. 5 shows a perspective illustration of a socket having an electrical plug.

In order to implement a bayonet-type connection, the socket 1 has, in its interior circumferential wall 20, two insertion channels 8. The insertion channels 8 of socket 1 extend along axis 44 and are radially angularly spaced from one another at angular spacings corresponding to the radial angular spacing of the lugs 5 on plug 2. In the embodiment illustrated in FIG. 5, the insertion channels are radially angularly spaced one hundred eighty degrees) (180° apart, so they lie diametrically opposite one another. tending in an axial direction 44. Insertion channels 8 of socket 1 are of a shape and dimensions complementary to those of corresponding ones of the lugs 5 of plug 2 such that the insertion channels 8 are capable of receiving each of the protruding lugs 5 of the plug 2 without undue mechanical interference or excessive play to allow the cylindrical portion 4 of plug 2 to be inserted into plug 1 without requiring undue insertion force.

Figure 7:
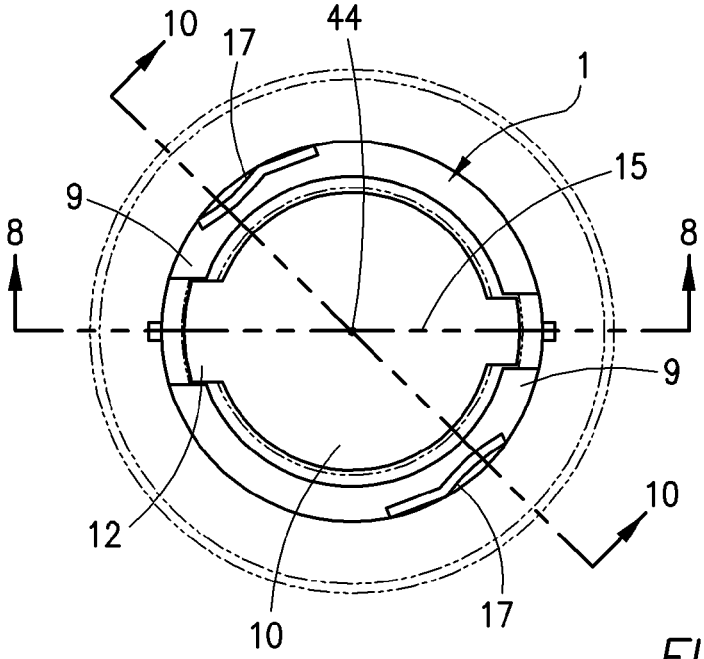
FIG. 7 shows a cross section through the socket shown in FIG. 1.

As can be seen for example from FIGS. 7 and 10, two locking channels 9 are formed penetrating into an inside circumferential wall 20 of socket 1. Each locking channel 9 runs circumferentially between an open first end 59 and a terminal second end 49. As shown in FIGS. 8A through 11B, the first end 59 adjoins and opens into one of the two axial insertion channels 8 to allow the lugs 5 to pass from one of the insertion channels 8 into the locking channel 9 when plug 2 and socket 1 are being connected to one another and to allow the lugs 5 to pass from the locking channel 9 into an adjoining insertion channel 8 into the locking channel 9 when plug 2 and socket 1 are being disconnected from one another.

To a provide a latching position 50, at least one, and preferably all of the locking channels 9 each include a depression 48 which is preferably located near its end 49. When the plug 2 is disposed with at least one, and preferably all, of its lugs 5 located in a depression 48, a latching position 50 is reached which serves to retain the lug 5 more securely in the locking channel 9 thereby helping to prevent unintentional detachment of plug 2 from socket 1 due to vibration, changes of dimension due to temperature changes in the environment of use or other extraneous external influences.

In order to detach the plug 2, from socket 1 it is merely necessary to move the plug 2 slightly further in, with the result that it can be withdrawn from the locking channels 9 and the insertion channels 8 again given a corresponding rotary movement in the opposite direction. Such a latching position 50 can also be achieved by providing a slightly inclined guidance of the locking channels 9 in the form of a cam surface 61. As shown in FIGS. 9A and 9B, as well as in FIGS. 11A and 11B, cam surface 61 is sloped such that the locking channel 9 progressively narrows in at least one cross-sectional dimension 77 over at least one region 79 located between its first end 59 and depression 48. In the embodiment of FIGS. 8A and 8B and 11A and 11B, respectively, region 79 extends substantially entirely from first end 59 to depression 48.

Figure 2:
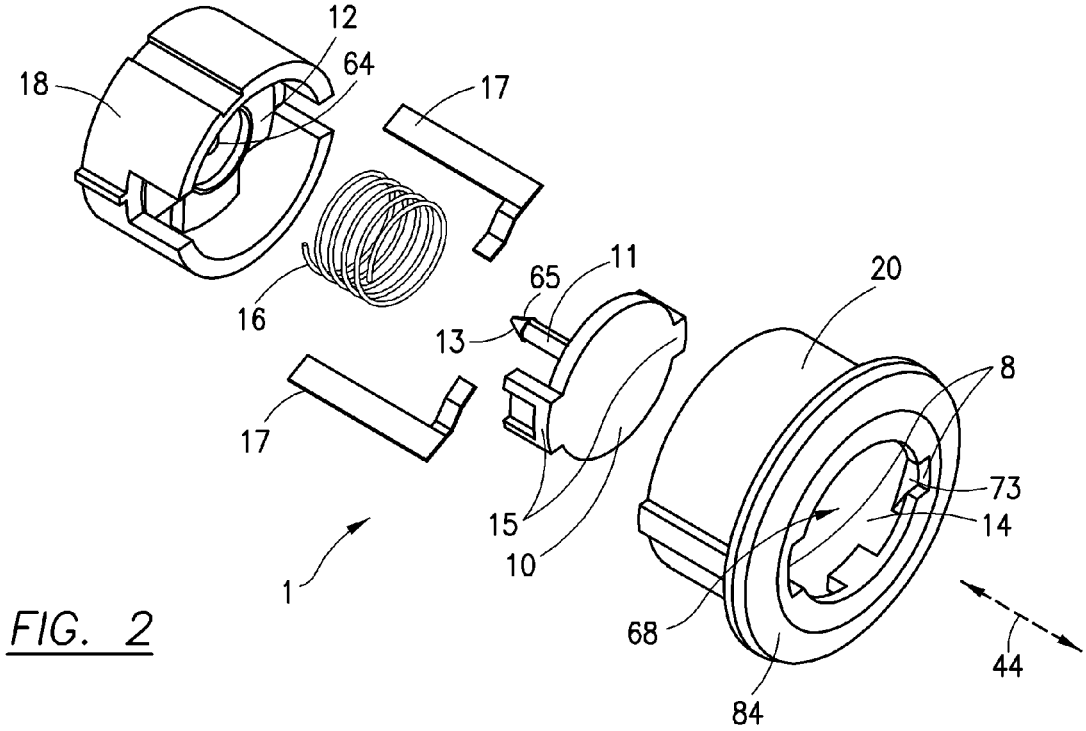
FIG. 2 shows an exploded illustration of the socket shown in FIG. 1.
Figure 3:
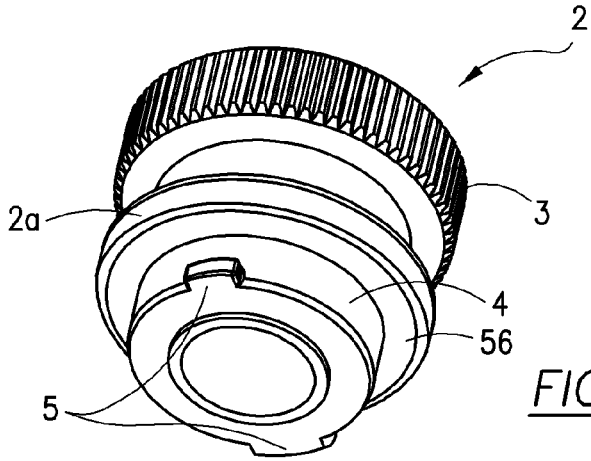
FIG. 3 shows a perspective illustration of a plug as a mechanical fastening element.

The design of a preferred embodiment of the socket 1 can be seen in more detail in FIG. 2 in conjunction with FIGS. 7 through 14. The exploded view of FIG. 2 shows socket 1 provided with a cover 10 having a pin 11 having a conical or arrow-shaped, barbed end 13 which includes a slot 65. The pin 11 can be inserted through a hole 64 in a rear base 12 of the socket 1, an arrow-shaped end 13, which is provided with the slot 65, of the pin 11 being plugged by being correspondingly compressed through the hole 64.

Owing to the slot 65, the barbed end 13 of the pin 11, which has a larger outer diameter than the shaft of the pin 11, can be forced through the hole momentarily compressing the sides of the slot 65. Thereafter, the slot expands so that the barbed end 13 of pin 11 resists subsequently withdrawal from the hole 64, thereby serving as a restraining element for the cover 10. The cover 10 is matched in terms of its shape to the shape of the opening 68 located at the front side 14 of the socket 1 and therefore likewise has lug-like protrusions 15 on opposite sides, which are matched to the insertion channels 8 to slide smoothly in the insertion channels 8. As can be seen in particular in FIGS. 1 to 5, the front opening 14 of the socket 1 is therefore covered by cover 10 with the cover 10 preferably terminating flush with the surface of the socket 1. A spring device 16 in the form of a helical spring forcibly biases the cover 10 toward its closed position, the barbed end 13 of pin 11 serving to stop against the base 12 and prevent the cover 10 from falling out of socket 1. The spring-like device 16 is supported on the base 12 of the socket 1. Mating contacts 17 are arranged opposite one another in the locking channels 9 in the circumferential wall 20 of the recessed socket 1. Wires or other electrical conductors (not illustrated) lead out of the mating contacts 17 to a current source or other desired electrical connection point. As can be seen in the exploded illustration shown in FIG. 2, for installation reasons, the housing of the socket 1 may be formed in two main parts, namely comprising the circumferential wall 20 of the recessed interior portion 73 and a rear socket part 18, which is inserted into the interior of the circumferential wall 20 and includes the base 12.

Figure 12:
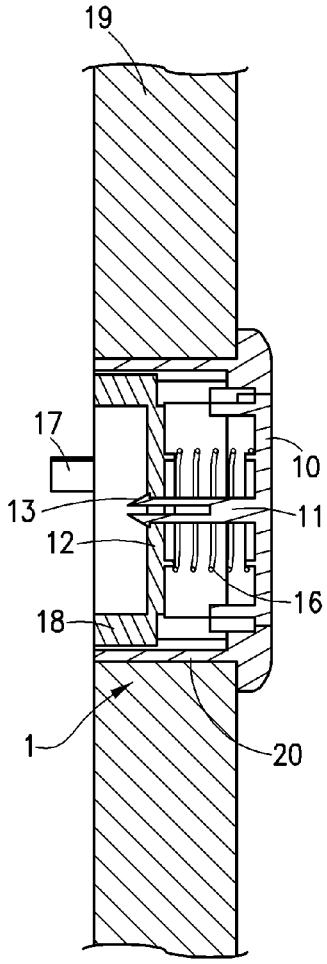
FIG. 12 is a sectional view taken along the line VIII-VIII of FIG. 7.
Figure 13:
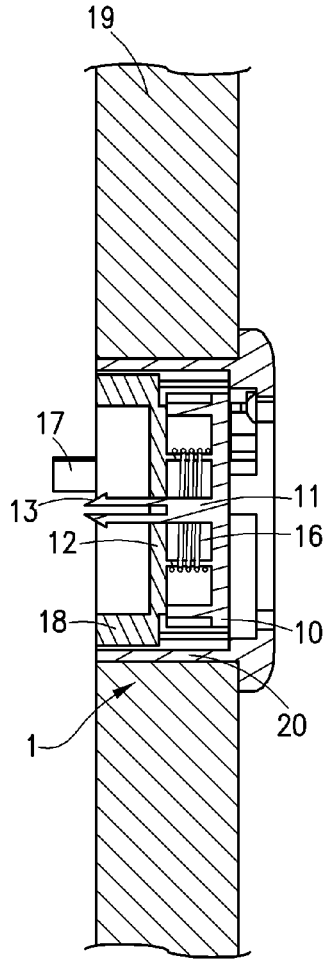
FIG. 13 is sectional view corresponding to the of FIG. 12 shown with a partially inserted cover.
Figure 14:
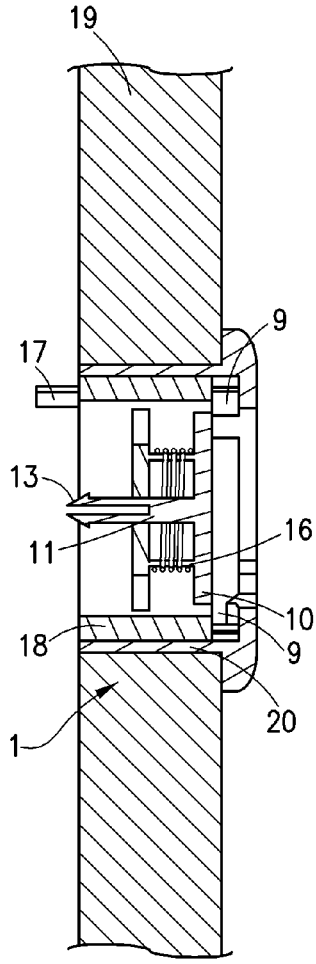
FIG. 14 shows a section along the line X-X of FIG. 7.

As can be seen in particular from FIGS. 12, 13 and 14, the socket 1 has a relatively small physical depth and can be inserted completely or virtually completely into a wall 19 surrounding the socket.

As can be seen, the connection system with the socket 1 and the plug 2, depending on the type of plug, can be used both as a mechanical fastening device and as an electrical connection device. If desired, socket 1 can be configured to accommodate either or both types of plugs 2*a* and/or 2*b*. In the case of a mechanical connection device with a mechanical plug 2*a*, there is simply no electrical contact connection with the mating contacts 17. Alternatively, plugs 2*a* and 2*b* can be dimensioned differently, so that a given socket 1 will accommodate a mechanical plug 2*a* but not an electrical plug 2*b*, or vice versa.

FIGS. 8A through 11B illustrate a number of alternative structures for the locking channels 9 of the socket 1 and for the lugs 5 of the plug 2.

Figure 8A:
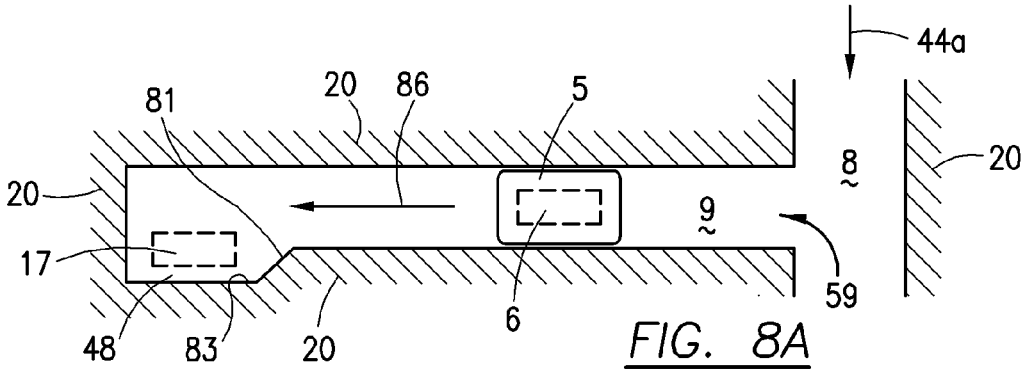
FIG. 8A is a partial cross sectional view illustrating the engagement of a first exemplary form of locking lug with a locking channel which terminates in a first exemplary form of depression.
Figure 8B:
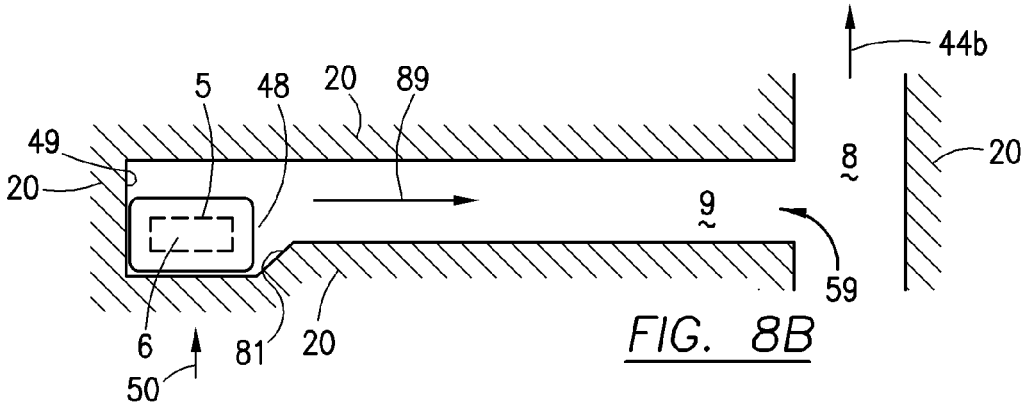
FIG. 8B is a partial cross sectional view corresponding to that of FIG. 8A except showing the locking lug engaged with the depression in a latching position.
Figure 9A:
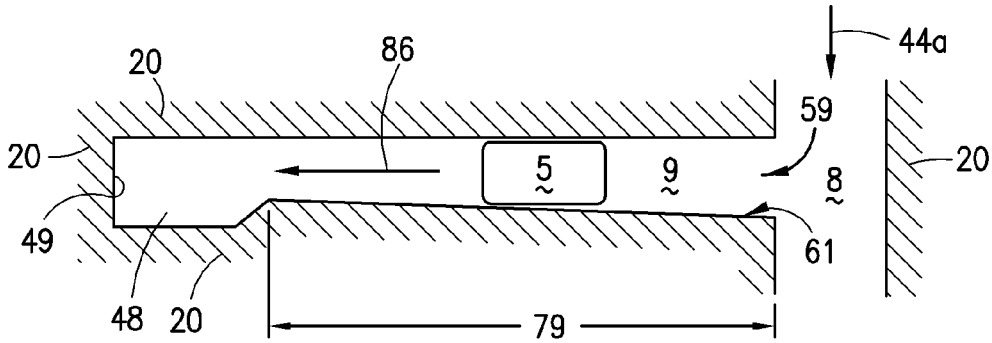
FIG. 9A is a partial, cross sectional view illustrating the engagement of a second exemplary form of locking lug with a ramped locking channel which terminates in a depression of the same form as that of FIGS. 8A and 8B.
Figure 9B:
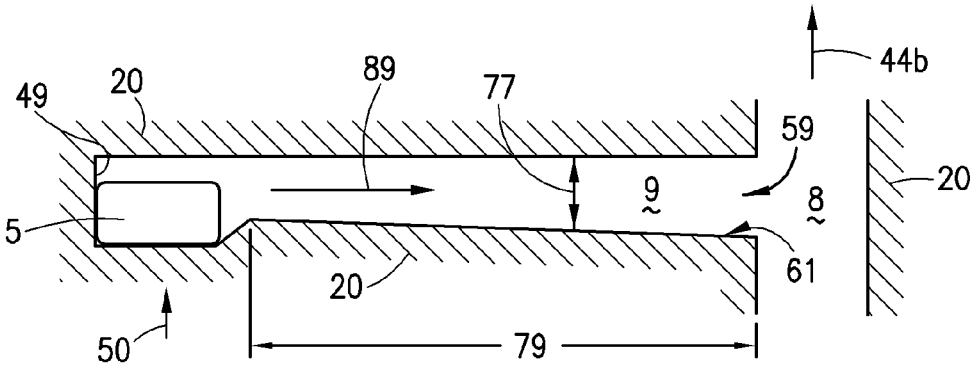
FIG. 9B is a partial cross sectional view corresponding to that of FIG. 9A except showing the locking lug engaged with the in a latching position.

As illustrated in FIGS. 8A and 8B the locking channel 9 may suitably be a slot of substantially uniform cross section between its first end 59 and a depression 48 which has a sloped front wall 81 terminating in a flat wall 83 which is dimensioned to permit lug 5 to rest along flat wall 83 when lug 5 is fully engaged at a latching position 51 as illustrated in FIG. 8B. In this embodiment, the lug 5 may suitably be a substantially rigid body of essentially rectangular cross section with suitably radiused edges. In a case in which plug 2 is an electrical plug 2*b*, each lug 5 carries one or more electrical contact elements 6.

In operation of embodiments constructed according to FIGS. 8A and 8B, upon insertion of plug 2 into socket 2 in axial insertion direction 44*a*, cover 10 is forcibly displaced from the opening 68 at the front of the interior recess of socket 1 and lug 5 passes into insertion channel 8. Upon full axial insertion, further axial movement in the insertion direction 44*a* is prevented by abutment of the front part 56 of plug 2 against the peripheral rim 84 of socket 1 or other mechanical stop (not shown), and lug 5 is aligned with the end 59 of locking channel 9. A user then effects relative rotation of plug 2 and socket 1 in a first rotational direction 86 having lug 5 to enter locking channel 5 and descend smoothly by way of sloped front wall 81, into depression 81 until arriving at a latching position 51 at which any significant further rotation in first rotational direction 81 is prevented by abutment of lug 5 with the solid face of the second end 49 of locking channel 9 as illustrated in FIG. 8B. If plug 2 is an electrical plug 2*b*, at latching position 50, the electrical contact 6 carried by lug 5 is positioned aligned with and in electrical contact with a mating electrical contact 17 mounted to a wall of insertion channel 9. At latching position 51, engagement of lug 5 with depression 5 retains lug 5 more securely in locking channel 9 and thereby helps prevent unintentional detachment of plug 2 from socket 1.

Disconnecting plug 2 from socket 1 proceeds in a reverse manner to making a connection between them. To disconnect, a user effects relative rotation of plug 2 and socket 1 in a second rotational direction 89 as indicated in FIG. 8B. Upon lug 51 entering insertion channel 44, further significant rotation in direction 89 is prevented by abutment of lug 5 against an opposing wall of insertion channel 8 whereupon plug 2 may be withdrawn from socket 1 by pulling plug 2 in the removal direction 44*b* which is a direction oriented parallel to axial direction 44 and is opposite insertion direction 44*a*. As plug 2 is withdrawn, cover 10 moves axially in a withdrawal direction 44*b* with plug 2 under the bias force applied by spring element 16 until coming to rest blocking opening 68 when plug 2 is completely withdrawn from the interior of socket 1.

Embodiments constructed according to FIGS. 9A and 9B, lug 5 is as described above in connection with FIGS. 8A and 8*b*. However, the locking channel includes a cam surface 61 which acts to urge the lug 5 into a progressively more secure engagement with locking channel as rotation in first rotational direction proceeds toward the depression 48 which, in this instance, also takes the same form described above with reference to FIGS. 8A and 8B, to provide a latching engagement with lug 5.

Figure 10A:
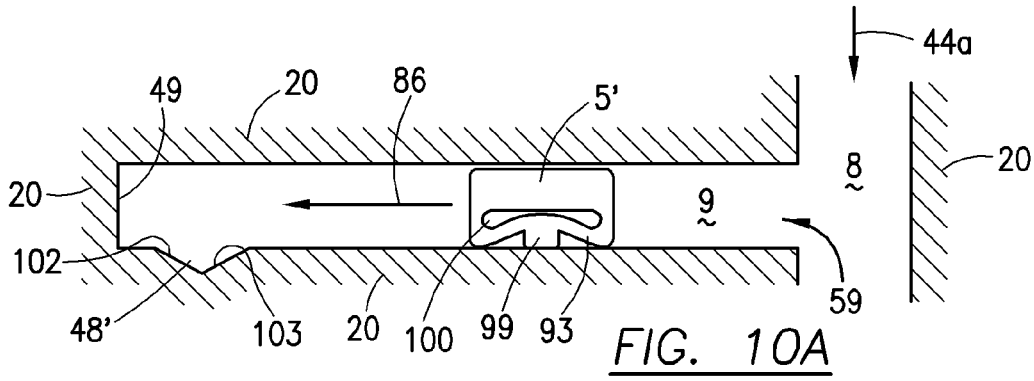
FIG. 10A is a partial, cross sectional view illustrating the engagement of a second exemplary form of locking lug with a locking channel which terminates in a second exemplary form of depression.
Figure 10B:
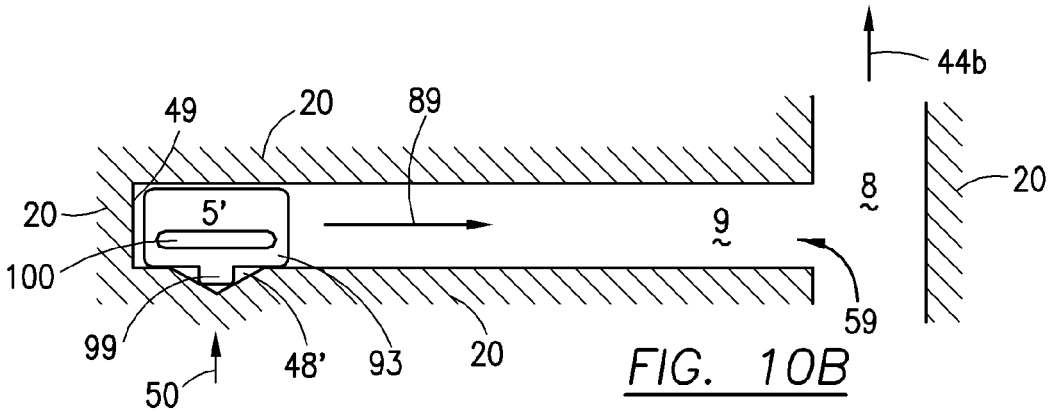
FIG. 10B is a partial, cross sectional view corresponding to that of FIG. 10A except showing the locking lug engaged with the depression in a latching position.

Embodiments constructed according to FIGS. 10A and 10B have a characteristic in common with one another, in that both include a spring 93 which aids the retention of lug 5 in its latching position 50.

In embodiments constructed according to FIGS. 10A and 10B, spring 93 is formed as an integral part of a lug 5' which may be formed of suitably compliant material. Lug 5' includes a projection 99, is carried by spring 93 and projects outwardly in a direction oriented to face depression 48 when lug 5' is in its latching position 50. As shown in FIG. 10B, spring 93 is compressed upon lug 5' entering locking channel 9.

To accommodate such compression as well as to determine the resultant biasing force, lug 5' may include a void 100 located adjacent spring 93 as shown. Locking channel 9 includes a depression 48' which has at least one, and preferably two ramped surfaces 102, 103 which intersect one another such that depression 48' has a substantially v-shaped profile. Upon lug 5' reaching its latching position, spring 93 relaxes at least partially, thereby positioning projection 99 inside depression 48' to latch lug 5' in place. In order to disconnect plug 2 from socket 1, rotation in second rotational direction 89 must be applied with sufficient torque to compress spring 93 sufficiently to allow lug 5' to pass back through the narrower remainder of locking channel 9 until passing into insertion channel 8 whereupon plug 2 may be disconnected from socket 1 by pulling plug 2 in removal direction 44*b*.

Figure 11A:
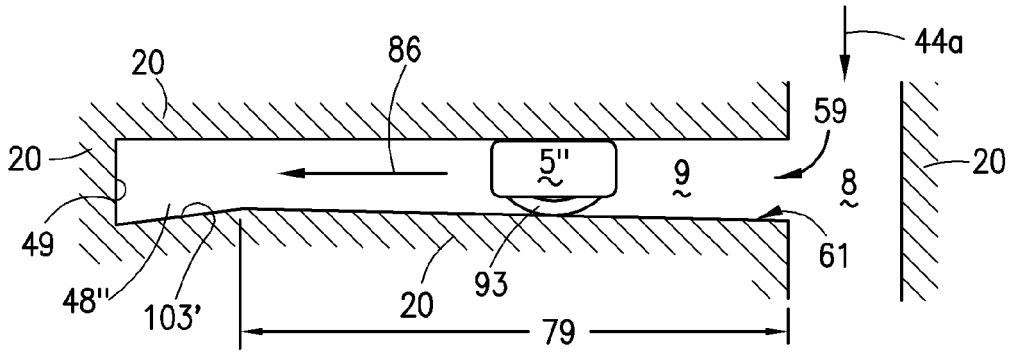
FIG. 11A is a partial cross sectional view illustrating the engagement of a third exemplary form of locking lug with a locking channel which terminates in a third exemplary form of depression.
Figure 11B:
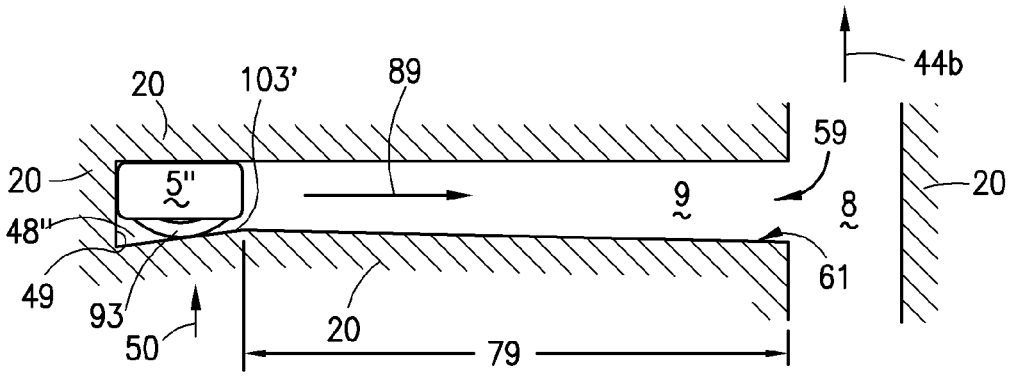
FIG. 11B is a partial cross sectional view corresponding to that of FIG. 11A except showing the locking lug engaged with the depression in a latching position.

In embodiments constructed according to FIGS. 11A and 11B, spring 93 takes the form of an element which is attached to a lug 5' which, except perhaps for dimensions or other minor details may be constructed substantially the same as the lug 5 described earlier. Spring 93 may be formed from thin metal sheet or other suitable material. Similar to embodiments constructed according to FIGS. 9A and 9B, the locking channel 9 of FIGS. 11A and 11B includes a cam surface 61 as described earlier which slopes progressively over a region 79 such that locking channel 9 narrows in at least one cross sectional dimension 77 located between the first end 59 and a depression 48". In these embodiments, depression 8" has a wall 103' which slopes unidirectionally such that within the area of depression 48', locking channel 9 progressively increases in cross sectional dimension 77 as the second end 49 of locking channel 9 is approached. The spring 93 is compressed by the action of cam surface 61 as depression 48" is approached due to rotation in first rotational direction 86. Upon entering depression 48", the spring 93 relaxes at least partially. This, in combination with the slope of wall 103 serve to retain lug 5' in place at its latching position.

Disconnection of plug 2 from socket 1 in connector apparatus constructed according to FIGS. 11A and 11B requires that relative rotation of plug 2 and socket 1 be effected in second rotational direction 89 with sufficient torque to allow spring 93 to pass out of depression 48". Thereafter, cam surface 89 will allow spring 93 to relax at least partially with the resultant release of spring force cooperating with cam surface 61 to assist the withdrawal of lug 5" from the locking channel.

In the embodiments constructed according to any of FIGS. 9A through 11B, the structure and operation of the cover 10 are as described above with reference, inter alia, to FIGS. 8A and 8B.

FIG. 12 shows the socket 1 with the cover 10 positioned closed over opening 68, the front surface of cover 10 lying with the front rim 84 side of the socket 1.

FIGS. 13 and 14 show the position of the cover 10 if the plug 2 is positioned in the socket 1. For clarity of illustration the plug 2 itself is not shown in FIGS. 13 and 14.

Instead of a cable connection of the plug 2*b* via the connection branch 7, an electrical load 42 can also be positioned directly on the electrical plug 2*b*, if desired. This can be seen in FIG. 6. In this case, the plug has a knurled nut 21 on its rear side, via which knurled nut a connection to an electrical load 22 (not illustrated in any more detail) takes place. The electrical load 22 may be, for example, a mobile telephone, a charger, a small display screen or other electrical device.

It is also possible to configure a connection system according to the invention to make more than two electrical contact connections. There are two basic possibilities for this. One, referred to herein for the sake of convenience as an axial addition format involves providing additional electrical contacts axially. The other possibility referred to herein for the sake of convenience as a circumferential addition format involves providing at least one lug 5 with a plurality of electrical contacts 5, or at least more than one electrical contact 5, with those contacts being disposed at radially angularly spaced intervals.

In one exemplary embodiment of a connector system according to an axial addition format, plug 2*b* includes a plurality of contact elements 6 each of which is arranged on one of a corresponding plurality of lugs 5 located mutually spaced from one another in the axial direction on the cylindrical portion of plug 2*b*. The mating socket 1 in such embodiment includes a corresponding plurality of locking channels 9 which are also mutually axially spaced from one another and are located at axial positions which match those of the lugs 5 when the cylindrical portion 4 of plug 2*b* is fully engaged with the socket 1.

An alternate embodiment of a connector system according to an axial addition format includes a plug 2*a* with at least one lug 5 having multiple electrical contacts disposed at mutually axially separated locations on the same lug 5. The axial spacings between the contacts 5 may be, but need not necessarily be, uniform. A mating socket 1 includes at least one insertion channel 8 adapted to mateably receive the aforementioned lug 5 and having an adjoining locking channel 9 within which is disposed a corresponding plurality of electrical contacts 17 which are mutually axially spaced from one another and are located at axial positions which match those of corresponding ones of the plurality of contacts 5 carried on the aforementioned lug 5 when plug 2*b* is fully engaged with socket 1. In such an embodiment, it will be appreciated that the length of the lug 5 in the axial direction 44 may need to be increased as required to accommodate a desired number of electrical contacts 5 of a desired size and that the insertion channel 8 will be of a corresponding axial length.

In an exemplary embodiment of a connector system with circumferential addition format, plug 2*b* includes at least one lug 5 having a plurality of electrical contacts 5, or at least having more than one electrical contact 5, with each of those electrical contacts 5 being mutually radially angularly spaced apart from one another on that same lug 5. The angular spacings between the contacts 5 may be, but need not necessarily be, uniform. A mating socket 1 includes a plurality of contact radially angularly spaced elements 17 disposed in a given locking channel 9. The locking channel 9 is of sufficient circumferential length to accommodate a desired number of radially angularly spaced electrical contacts 17 of desired size. Each of the contact elements 17 is positioned within the locking channel 9 at one of a plurality of angular locations at which it is electrically and mechanically mateable with a corresponding one of a plurality of electrical contacts 6 carried on the lugs 5 of plug 2*b* when the plug 2*b* and socket 1 are fully engaged with one another. In this case, the plurality of lugs 5 of the plug 2*b* are arranged at the same axial position such that they are offset from one another circumferentially rather than axially.

In light of the foregoing, it will also be appreciated that axial and circumferential addition arrangements as described above are not mutually exclusive and that also within the scope of the invention are hybrid connector systems, which combine one or more of the axial addition formats with one or more of the circumferential addition formats mentioned above.

FIGS. 15 through 18 illustrate an exemplary alternative embodiment of the connection system according to the invention having a plug 2' having a different configuration.

Figure 15:
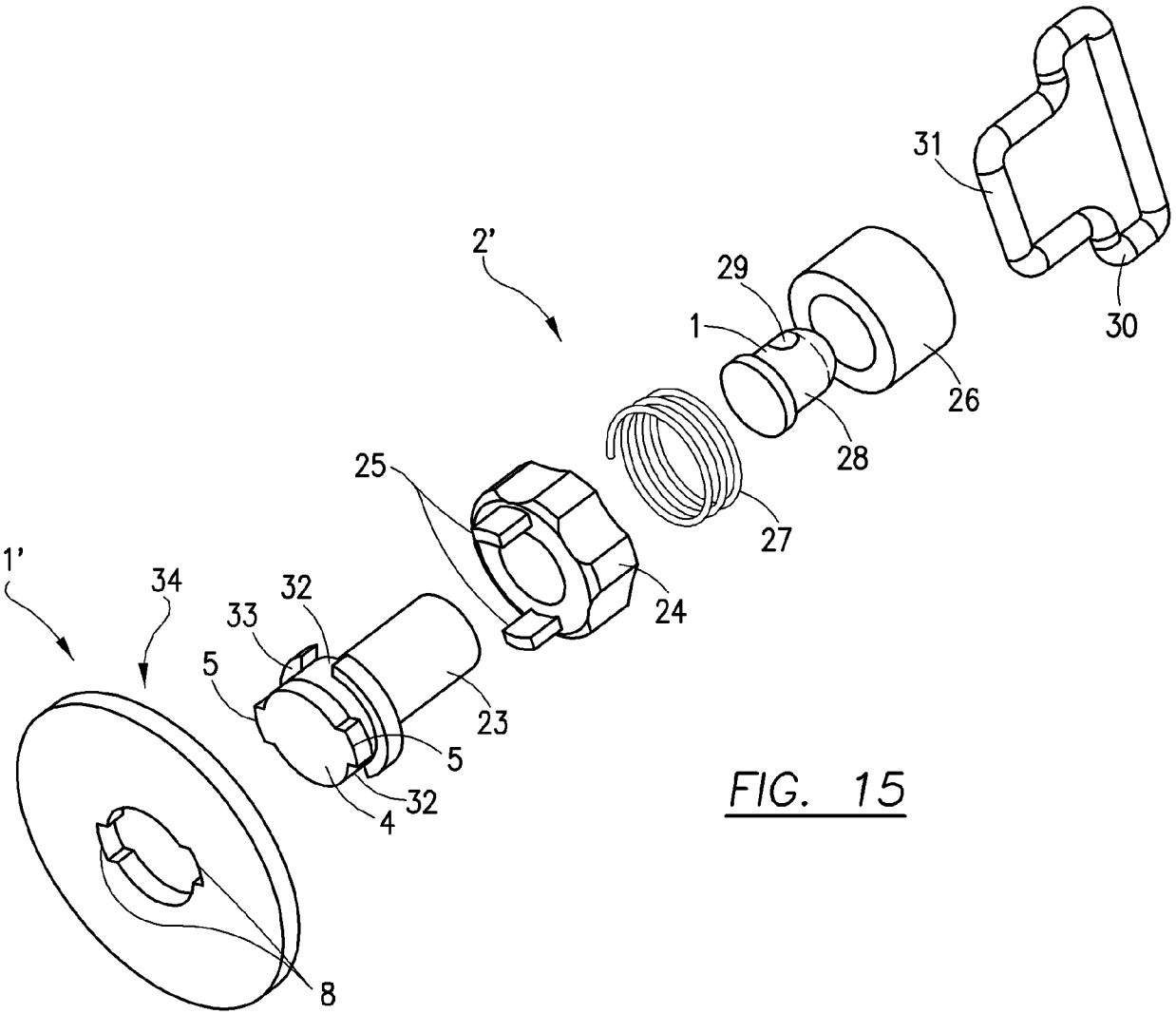
FIG. 15 is a perspective, exploded view of an alternative embodiment of a plug and socket.

As shown in FIG. 15 the plug 2' has a cam carrier 23, at whose front end facing the socket 1' the round part 4 is provided with the two cams or lugs 5 lying opposite one another.

On the side of the cam carrier 23 which is remote from the socket 1', a locking part in the form of a locking ring 24 is located which is pushed onto a cylindrical part of the cam carrier 23. Two locking cams 25, which protrude axially out of the locking ring 24, are located opposite one another on the front wall region, which faces the socket 1', of the locking ring 24. As is shown, the two locking cams 25 are offset in the circumferential direction with respect to the cams or lugs 5 by ninety degrees (90°. A grip part in the form of a grip ring 26 is located on the side remote from the socket 1'. A spring device in the form of a helical spring 27 is arranged between the grip ring 26 and the locking ring 24.

The grip ring 26 has an inner drilled hole, into which a rotary part 28 with a transverse drilled hole 29 is inserted, the rotary part 28 being capable of being rotated with respect to the grip ring 26. A fastening element, for example a retaining eye 30, is provided with a transverse part 31, which is guided through the transverse drilled hole 29. The retaining eye 30 serves the purpose of fastening parts which are intended to be secured, for example, in the trunk of a vehicle. Owing to the fact that the rotary part 28 is capable of rotating, in this case the retaining eye 30 can be positioned in any desired rotary position.

While the grip ring 26 is rigidly connected to the cam carrier 23, the locking ring 24 is capable of being displaced in the axial direction with respect to the cam carrier 23. Owing to the locking cams 25, which protrude into cutouts 32 of a circumferential ring 33 of the cam carrier 23, however, the cam carrier 23 and the locking ring 24 are prevented from rotating or are caused to rotate jointly.

The way in which the connection system with the plug 2' shown in FIG. 15 functions will become apparent below using descriptions relating to FIGS. 16 through 18.

Figure 16:
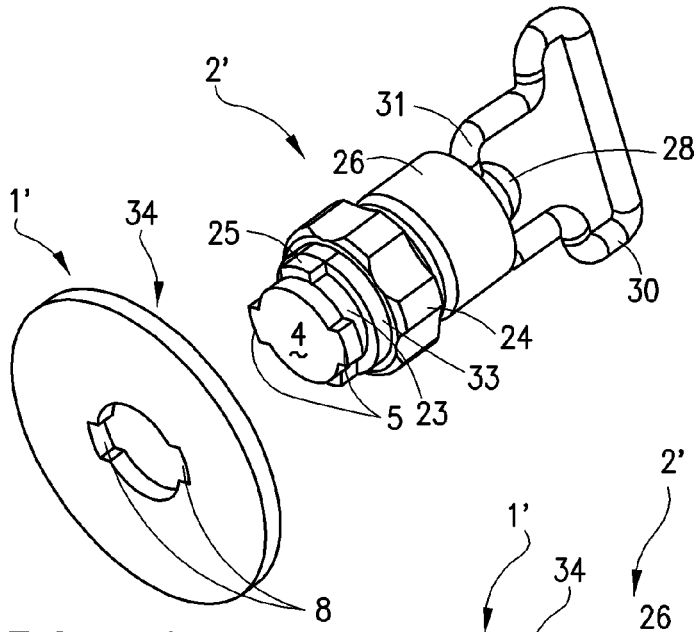
FIG. 16 shows a perspective view of the plug shown in FIG. 15 in an assembled state prior to the plug being inserted into a socket or into a profiled drilled hole of a wall.

In a first step, as shown in FIG. 16, the plug 2' is brought close to the socket 1' such that the insertion channels 8 are rotationally aligned with the lugs 5. Owing to the prestress by means of the helical spring 27 tensioned between the grip part 26 and the locking ring 24, the locking ring 24 bears against the circumferential ring 33 of the cam carrier 23, the locking cams 25 protruding in the direction of the socket 1' forwards through the cutouts 32 over the circumferential ring 33.

Figure 17:
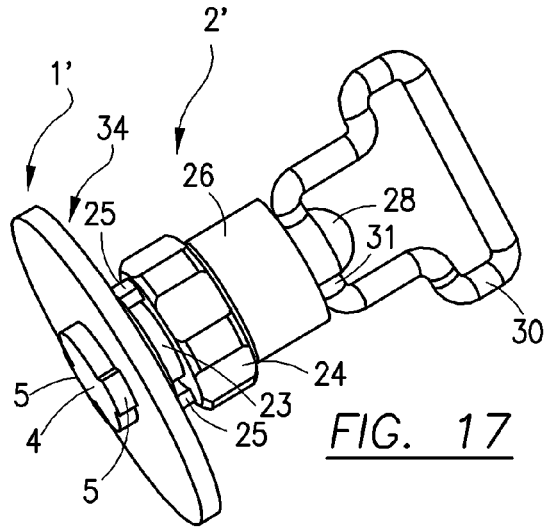
FIG. 17 is a perspective view of the plug of FIG. 15 inserted into the socket.
Figure 18:
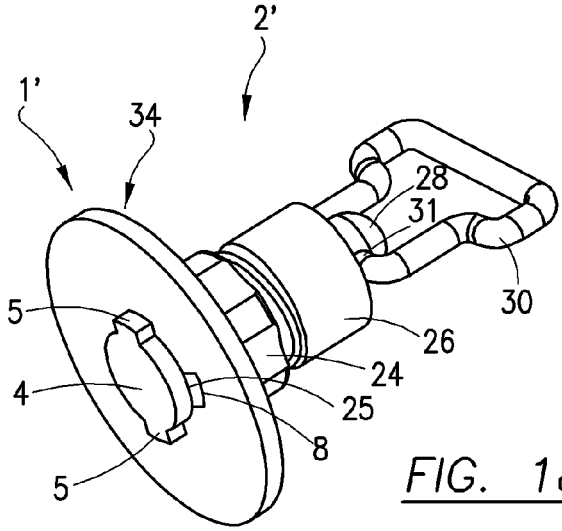
FIG. 18 is a perspective view of the plug FIG. 15 shown inserted into the socket, in a locking position.

FIG. 17 shows the position of the plug 2' in which the cams 5 have been pushed through the insertion channels 8 of the socket 1'. While the lugs 5 are being pushed through the insertion channels 8, the locking cams 25 abut a wall 34 of the socket 1' with their front side, which wall 34 faces the plug 2'. On overcoming the prestress applied by the spring 27, the locking ring 24 is pushed back during the insertion movement of the lugs 5 into the insertion channels 8. As soon as the lugs 5 are located on the rear side of the wall part 34 and therefore the lugs 5 can be rotated in the circumferential direction, the grip ring 26 and therefore also the cam carrier 23, which is rigidly connected to it, can be rotated in the circumferential direction through a desired angle. The angle of the rotary movement depends on the positioning of the locking cams 25 in relation to the lugs 5. Since the angular difference is ninety degrees (90°) in this case, a corresponding rotary movement by the operator through ninety degrees (90°) takes place on the grip ring 26. Once this rotary movement has ended, the locking cams 25 are therefore in front of the insertion channels 8 and, since they correspond to the channel shapes of the insertion channels 8 in terms of shape and configuration, the locking cams 25 are pressed into the insertion channels 8 by means of the spring 26 which is being relieved of tension, whereby locking and, at the same time, protection against rotation is provided (see FIG. 14). The cams 5, which, as can be seen in FIG. 18, are arranged such that they are offset through 90° with respect to the insertion channels 8, ensure that the plug 2' cannot be withdrawn from the socket 1 in the axial direction.

In order to release the plug 2' from the socket 1', it is merely necessary to manually pull back the locking ring 24 against the force of the spring 27 from the socket 1' until the locking cams 25 are released from the insertion channels 8. Then, with a back-rotation through 90°, the lugs 5 are again brought in front of the insertion channels 8, and the plug 2' can be withdrawn.

The rotary movement in the form of 90° is naturally only mentioned by way of example. In practice, other values are also possible here.

The advantage of the exemplary embodiment with the plug 2' in comparison with the plug 2 described initially consists, inter alia, in that the socket 1' can have a substantially simpler design. In practice, only one wall 34 is required as the "socket", which wall is provided with a profiled drilled hole which has cutouts in the form of the insertion channels 8. This means that, if there is a sufficient wall thickness, for example of at least 1 to 2 millimeters, the connection system according to the invention can be introduced in a simple manner at any desired point in available walls, for example in walls of a trunk in a vehicle. If there is a sufficient wall thickness for the wall 34 or if this wall is correspondingly reinforced, it is thus possible with the connection system according to the invention also to attach heavy loads or thereby secure heavy loads on the retaining eye 30 of the plug 2'.

Figure 6:
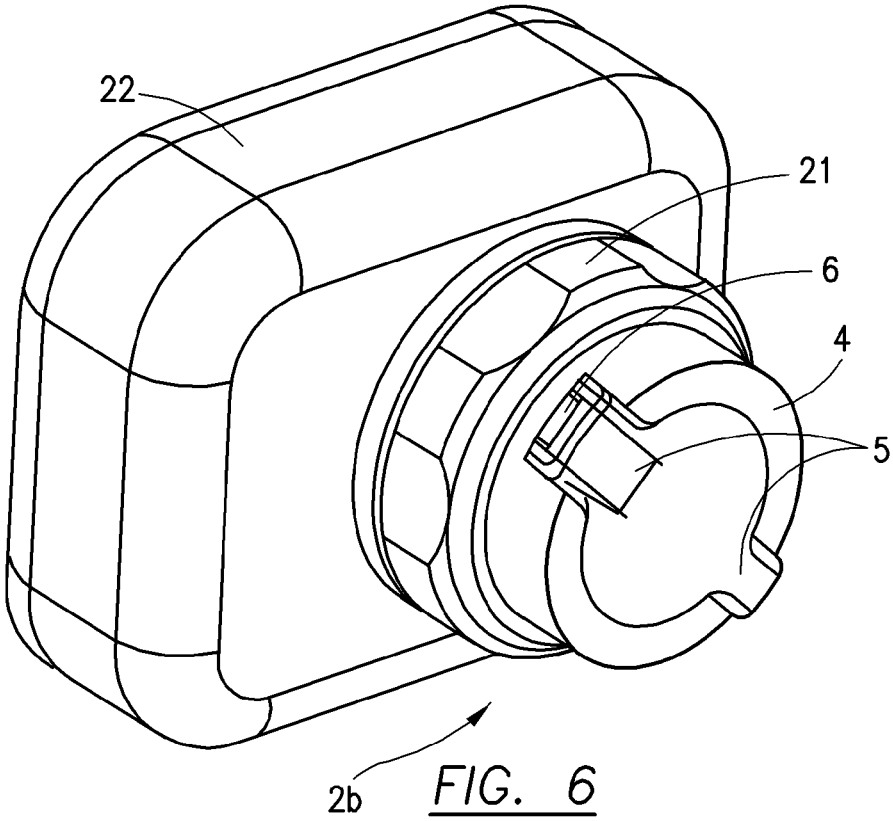
FIG. 6 shows a perspective illustration of an electrical plug having a connecting element for an electrical load.

A further advantage in comparison with the exemplary embodiment shown in FIGS. 1 through 14 also consists in the fact that, as a result of the ability of the rotary part 28 to rotate in relation to the grip ring 26, the retaining eye 30, which is connected to the rotary part 28, can remain unchanged in the event of a rotation of the plug 2' during insertion into the socket 1' for the purpose of locking it in its position. This means that it is not rotated as well and parts located on it or else electrical loads provided in place of the retaining eye 30 remain in their original position. In the embodiment shown in FIGS. 1 to 10, the electrical load 22 illustrated in FIG. 6 is rotated along when the bayonet-type connection is produced, which could lead to problems in the event of the need for a positionally correct arrangement of the electrical load 22, the retaining eye 30 or another part which is connected to the retaining eye 30 or to the plug 2' itself.

The cam carrier 23 and the grip ring 26 can be rigidly connected to one another in any desired manner. This can take place, for example, by means of a screw connection or adhesion.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A connection apparatus, comprising:

a plug having at least one lug, and a socket having a recessed interior portion, said interior portion adapted for receiving said plug by way of insertion of said plug into said interior portion by way of an opening for making a connection between said socket and said plug, said opening communicating with said interior portion and being formed in said socket at a location adjacent said front side of said socket; said socket further having at least one insertion channel within which said lug may be received, said insertion channel extending in an axial direction, said axial direction corresponding to a direction of insertion of said plug into said socket and a direction of removal of said plug from said socket; said socket further having at least one locking channel within which said lug may be received, said locking channel including a cam surface and extending in a direction oriented generally transverse to said axial direction and having a first end by way of which said locking channel communicates with said insertion channel and a second end which is radially angularly offset from said first end, said locking channel including at least one depression adapted for latching engagement with said lug, said depression including a ramp surface which slopes oppositely of said cam surface.

2. A connection apparatus as claimed in claim 1, wherein said depression is located adjacent said second end of said locking channel.

3. A connection apparatus as claimed in claim 1, wherein said cam surface is sloped such that said locking channel progressively narrows in at least one cross-sectional dimension over at least one region located between said first opening and said depression.

4. A connection apparatus as claimed in claim 3, wherein said region extends substantially from said first end to said depression.

5. A connection apparatus as claimed in claim 1, further comprising a spring element which urges at least a portion of said lug into said depression.

6. A connection apparatus as claimed in claim 5, wherein said portion of said lug comprises a projection.

7. A connection apparatus as claimed in claim 1, wherein said depression includes at least one ramped surface.

8. A connection apparatus as claimed in claim 7, wherein said at least one ramped surface comprises a pair of ramped surfaces having a substantially v-shaped profile.

9. A connection apparatus as claimed in claim 1, further comprising:

a displaceable cover for selectively covering said opening when said plug is not received in said interior portion and for clearing said opening when said plug is received within said interior portion, said cover being displaceable within said interior portion and mounted for displacement away from said opening and in said direction of insertion responsive to insertion of said plug into said socket and for displacement toward said opening and in said direction of removal to a position covering said opening responsive to removal of said plug from said socket.

10. A connection apparatus, comprising:

a plug having at least one lug, and a socket having a recessed interior portion, said interior portion adapted for receiving said plug by way of insertion of said plug into said interior portion by way of an opening for making a connection between said socket and said plug, said opening communicating with said interior portion and being formed in said socket at a location adjacent said front side of said socket; said socket further having at least one insertion channel within which said lug may be received, said insertion channel extending in an axial direction, said axial direction corresponding to a direction of insertion of said plug into said socket and a direction of removal of said plug from said socket; said socket further having at least one locking channel within which said lug may be received, said locking channel including a cam surface and extending in a direction oriented generally transverse to said axial direction and having a first end by way of which said locking channel communicates with said insertion channel and a second end which is radially angularly offset from said first end, said locking channel including at least one depression adapted for latching engagement with said lug;

said apparatus further comprising a spring element operably disposed between said lug and said cam surface.

11. A connection apparatus, comprising:

a plug having at least one lug, and a socket having a recessed interior portion, said interior portion adapted for receiving said plug by way of insertion of said plug into said interior portion by way of an opening for making a connection between said socket and said plug, said opening communicating with said interior portion and being formed in said socket at a location adjacent said front side of said socket; said socket further having at least one insertion channel within which said lug may be received, said insertion channel extending in an axial direction, said axial direction corresponding to a direction of insertion of said plug into said socket and a direction of removal of said plug from said socket; said socket further having at least one locking channel within which said lug may be received, said locking channel extending in a direction oriented generally transverse to said axial direction and having a first end by way of which said locking channel communicates with said insertion channel and a second end which is radially angularly offset from said first end, said locking channel including at least one depression adapted for latching engagement with said lug; and a spring element which urges at least a portion of said lug into said depression, wherein said portion of said lug comprises a projection and wherein said projection is carried by said spring element.

12. A connection apparatus, comprising:

a plug having at least one lug, and a socket having a recessed interior portion, said interior portion adapted for receiving said plug by way of insertion of said plug into said interior portion by way of an opening for making a connection between said socket and said plug, said opening communicating with said interior portion and being formed in said socket at a location adjacent said front side of said socket; said socket further having at least one insertion channel within which said lug may be received, said insertion channel extending in an axial direction, said axial direction corresponding to a direction of insertion of said plug into said socket and a direction of removal of said plug from said socket; said socket further having at least one locking channel within which said lug may be received, said locking channel including a cam surface and extending in a direction oriented generally transverse to said axial direction and having a first end by way of which said locking channel communicates with said insertion channel and a second end which is radially angularly offset from said first end, said locking channel including at least one depression adapted for latching engagement with said lug;

said apparatus further comprising a spring element operably disposed between said lug and said cam surface, said spring element forming an integral part of said lug.

* * * * *

UNITED STATES PATENT AND TRADEMARK OFFICE

CERTIFICATE OF CORRECTION

Figure 4:
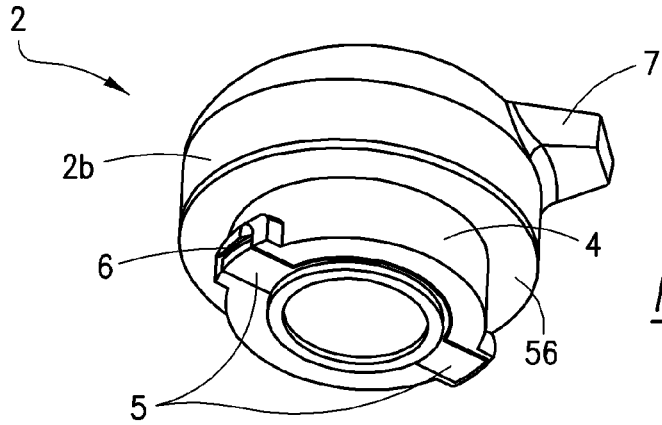
FIG. 4 shows a perspective illustration of an electrical plug.

PATENT NO. : 8,267,710 B2
APPLICATION NO. : 12/987964
DATED : September 18, 2012
INVENTOR(S) : Klaus Pfeiffer It is certified that error appears in the above-identified patent and that said Letters Patent is hereby corrected as shown below:

Column 3, line 60
delete "in FIG. 4 or 4." and change to --in FIG. 4.--

Column 4, line 15
delete "degrees) (180° apart" and change to --degrees (180°) apart--

Column 4, line 16
delete "another. tending" and change to --another tending--

Column 7, line 61
delete "contacts being" and change to --contacts 5 being--

Column 9, line 1
delete "degrees (90°." and change to --degrees (90°)--

Signed and Sealed this
Second Day of April, 2013

Teresa Stanek Rea
*Acting Director of the United States Patent and Trademark Office*